US005649055A

United States Patent [19]

Gupta et al.

[11] Patent Number: 5,649,055

[45] Date of Patent: Jul. 15, 1997

[54] VOICE ACTIVITY DETECTOR FOR SPEECH SIGNALS IN VARIABLE BACKGROUND NOISE

[75] Inventors: Prabhat K. Gupta; Shrirang Jangi, both of Germantown, Md.; Allan B. Lamkin, Arlington, Va.; W. Robert Kepley, III; Adrian J. Morris, both of Gaithersburg, Md.

[73] Assignee: Hughes Electronics, Los Angeles, Calif.

[21] Appl. No.: 536,507

[22] Filed: Sep. 29, 1995

Related U.S. Application Data

[63] Continuation of Ser. No. 38,734, Mar. 26, 1993, Pat. No. 5,459,814.

[51] Int. Cl.[6] ..... G10L 9/00

[52] U.S. Cl. ..... 395/2.42; 395/2.17; 395/2.19; 395/2.22; 395/2.23; 395/2.24; 395/2.35; 395/2.62; 395/2.57

[58] Field of Search ..... 395/2, 2.17, 2.19, 395/2.23, 2.24, 2.35–2.37, 2.42, 2.55, 2.57, 2.62, 2.22; 381/42, 46

[56] References Cited

U.S. PATENT DOCUMENTS

| | | | |
|---|---|---|---|
| 4,052,568 | 10/1977 | Jankowski | 381/46 |
| 4,239,936 | 12/1980 | Sakoe | 395/2.42 |
| 4,331,837 | 5/1982 | Soumagne | 395/2.42 |
| 4,357,491 | 11/1982 | Daaboul et al. | 395/2.42 |
| 4,700,394 | 10/1987 | Selbach et al. | 381/46 |
| 4,821,325 | 4/1989 | Martin et al. | 395/2.42 |
| 5,159,638 | 10/1992 | Naito et al. | 381/46 |
| 5,222,147 | 6/1993 | Koyama | 381/46 |
| 5,293,588 | 3/1994 | Satoh et al. | 395/2.42 |

*Primary Examiner*—Allen R. MacDonald
*Assistant Examiner*—Alphonso A. Collins
*Attorney, Agent, or Firm*—J. T. Whelan; Wanda Denson-Low

[57] ABSTRACT

A voice activity detector (VAD) which determines whether received voice signal samples contain speech by deriving parameters measuring short term time domain characteristics of the input signal, including the average signal level and the absolute value of any change in average signal level, and comparing the derived parameter values with corresponding thresholds, which are periodically monitored and updated to reflect changes in the level of background noise, thereby minimizing clipping and false alarms.

20 Claims, 6 Drawing Sheets

VOICE ACTIVITY DETECTOR FOR SPEECH SIGNALS IN VARIABLE BACKGROUND NOISE

CROSS REFERENCE TO RELATED APPLICATION

This is a continuation of application Ser. No. 08/038,734 filed Mar. 26, 1993, now U.S. Pat. No. 5,459,814.

The invention described herein is related in subject matter to that described in our application entitled "REAL-TIME IMPLEMENTATION OF A 8KBPS CELP CODER ON A DSP PAIR", Ser. No. 08/037,193, by Prabhat K. Gupta, Walter R. Kepley III and Allan B. Lamkin, filed concurrently herewith and assigned to a common assignee. The disclosure of that application is incoporated herein by reference.

DESCRIPTION

BACKGROUND OF THE INVENTION

1. Field of the Invention

The present invention generally relates to wireless communication systems and, more particularly, to a voice activity detector having particular application to mobile radio systems, such a cellular telephone systems and air-to-ground telephony, for the detection of speech in noisy environments.

2. Description of the Prior Art

A voice activity detector (VAD) is used to detect speech for applications in digital speech interpolation (DSI) and noise suppression. Accurate voice activity detection is important to permit reliable detection of speech in a noisy environment and therefore affects system performance and the quality of the received speech. Prior art VAD algorithms which analyze spectral properties of the signal suffer from high computational complexity. Simple VAD algorithms which look at short term time characteristics only in order to detect speech do not work well with high background noise.

There are basically two approaches to detecting voice activity. The first are pattern classifiers which use spectral characteristics that result in high computational complexity. An example of this approach uses five different measurements on the speech segment to be classified. The measured parameters are the zero-crossing rate, the speech energy, the correlation between adjacent speech samples, the first predictor coefficient from a 12-pole linear predictive coding (LPC) analysis, and the energy in the prediction error. This speech segment is assigned to a particular class (i.e., voiced speech, un-voiced speech, or silence) based on a minimum-distance rule obtained under the assumption that the measured parameters are distributed according to the multidimensional Gaussian probability density function.

The second approach examines the time domain characteristics of speech. An example of this approach implements an algorithm that uses a complementary arrangement of the level, envelope slope, and an automatic adaptive zero crossing rate detection feature to provide enhanced noise immunity during periods of high system noise.

SUMMARY OF THE INVENTION

It is therefore an object of the present invention to provide a voice activity detector which is computationally simple yet works well in a high background noise environment.

According to the present invention, the VAD implements a simple algorithm that is able to adapt to the background noise and detect speech with minimal clipping and false alarms. By using short term time domain parameters to discriminate between speech and silence, the invention is able to adapt to background noise. The preferred embodiment of the invention is implemented in a CELP coder that is partitioned into parallel tasks for real time implementation on dual digital signal processors (DSPs) with flexible inter-task communication, prioritization and synchronization with asynchronous transmit and receive frame timings. The two DSPs are used in a master-slave pair. Each DSP has its own local memory. The DSPs communicate with each other through interrupts. Messages are passed through a dual port RAM. Each dual port RAM has separate sections for command-response and for data. While both DSPs share the transmit functions, the slave DSP implements receive functions including echo cancellation, voice activity detection and noise suppression.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF A PREFERRED EMBODIMENT OF THE INVENTION

Figure 1:
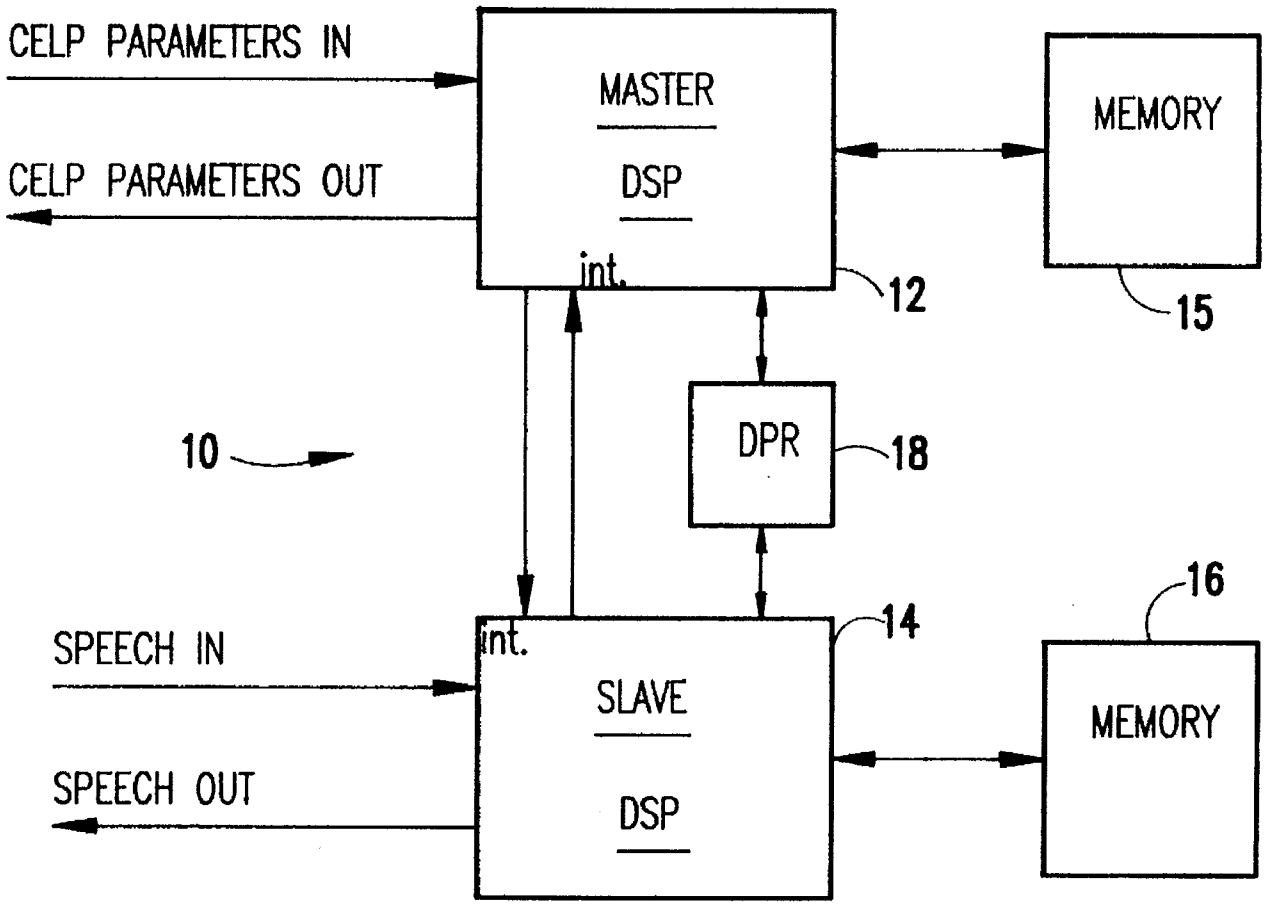
FIG. 1 is a block diagram showing the architecture of the CELP coder in which the present invention is implemented.

Referring now to the drawings, and more particularly to FIG. 1, there is shown a block diagram of the architecture of the CELP coder 10 disclosed in application Ser. No. 08/037,193 on which the preferred embodiment of how the invention is implemented. Two DSPs 12 and 14 are used in a master-slave pair; the DSP 12 is designated the master, and DSP 14 is the slave. Each DSP 12 and 14 has its own local memory 15 and 16, respectively. A suitable DSP for use as DSPs 12 and 14 is the Texas Instruments TMS320C31 DSP. The DSPs communicate to each other through interrupts. Messages are passed through a dual port RAM 18. Dual port RAM 18 has separate sections for command-response and for data.

The main computational burden for the speech coder is adaptive, and stochastic code book searches on the transmitter and is shared between DSPs 12 and 14. DSP 12 implements the remaining encoder functions. All the speech decoder functions are implemented on DSP 14. Echo canceler and noise suppression are implemented on DSP 14 also.

The data flow through the DSPs is as follows for the transmit side. DSP 14 collects 20 ms of μ-law encoded samples and converts them to linear values. These samples are then echo canceled and passed on to DSP 12 through the dual port RAM 18. The LPC (Linear Predictive Coding) analysis is done in DSP 12, which then computes CELP vectors for each subframe and transfers it to DSP 14 over the dual port RAM 18. DSP 14 is then interrupted and assigned the task to compute the best index and gain for the second half of the codebook. DSP 12 computes the best index and gain for the first half of the codebook and chooses between the two based on the match score. DSP 12 also updates all the filter states at the end of each subframe and computes the speech parameters for transmission.

Synchronization is maintained by giving the transmit functions higher priority over receive functions. Since DSP 12 is the master, it preempts DSP 14 to maintain transmit timing. DSP 14 executes its task in the following order: (i) transmit processing, (ii) input buffering and echo cancellation, and (iii) receive processing and voice activity detector.

The loading of the DSPs is tabulated in Table 1.

TABLE 1

Maximum Loading for 20 ms frames

| | DSP 12 | DSP 14 |
|---|---|---|
| Speech Transmit | 19 | 11 |
| Speech Receive | 0 | 4 |
| Echo Canceler | 0 | 3 |
| Noise Suppression | 0 | 3 |
| Total | 19 | 19 |
| Load | 95% | 95% |

It is the third (iii) priority of DSP 14 tasks to which the subject invention is directed, and more particularly to the task of voice activity detection.

For the successful performance of the voice activity detection task, the following conditions are assumed:

1. A noise canceling microphone with close-talking and directional properties is used to filter high background noise and suppress spurious speech. This guarantees a minimum signal to noise ratio (SNR) of 10 dB.
2. An echo canceler is employed to suppress any feedback occurring either due to use of speakerphones or acoustic or electrical echoes.
3. The microphone does not pick up any mechanical vibrations.

Speech sounds can be divided into two distinct groups based on the mode of excitation of the vocal tract:

Voiced: vowels, diphthongs, semivowels, voiced stops, voiced fricatives, and nasals.

Un-voiced: whispers, un-voiced fricatives, and un-voiced stops.

The characteristics of these two groups are used to discriminate between speech and noise. The background noise signal is assumed to change slowly when compared to the speech signal.

The following features of the speech signal are of interest:

Level—Voiced speech, in general, has significantly higher energy than the background noise except for onsets and decay; i.e., leading and trailing edges. Thus, a simple level detection algorithm can effectively differentiate between the majority of voiced speech sound and background noise.

Slope—During the onset or decay of voiced speech, the energy is low but the level is rapidly increasing or decreasing. Thus, a change in signal level or slope within an utterance can be used to detect low level voiced speech segments, voiced fricatives and nasals. Un-voiced stop sounds can also be detected by the slope measure.

Zero Crossing—The frequency of the signal is estimated by measuring the zero crossing or phase reversals of the input signal. Un-voiced fricatives and whispers are characterized by having much of the energy of the signal in the high frequency regions. Measurement of signal zero crossings (i.e., phase reversals) detects this class of signals.

Figure 2:
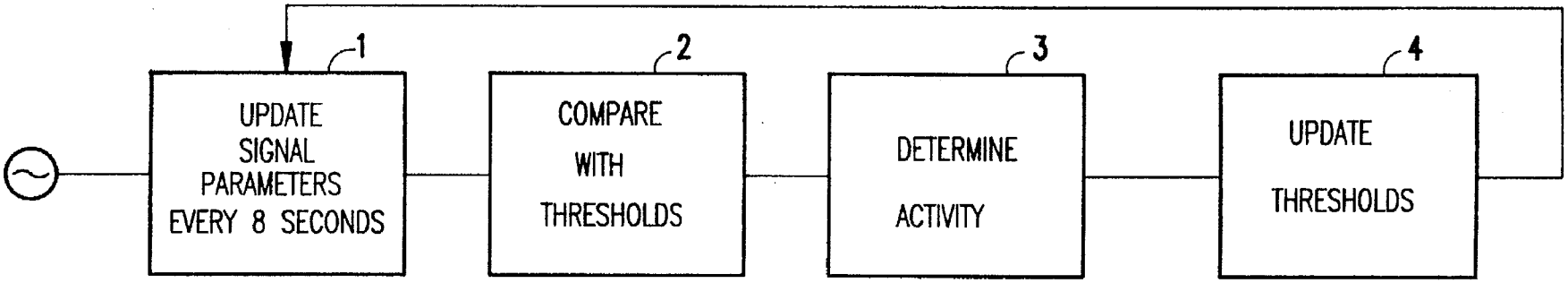
FIG. 2 is a functional block diagram showing the overall voice activity detection processes according to a preferred embodiment of the invention.

FIG. 2 is a functional block diagram of the implementation of a preferred embodiment of the invention in DSP 14. The speech signal is input to block 1 where the signal parameters are updated periodically, preferably every eight samples. It is assumed that the speech signal is corrupted by prevalent background noise.

Figure 3:
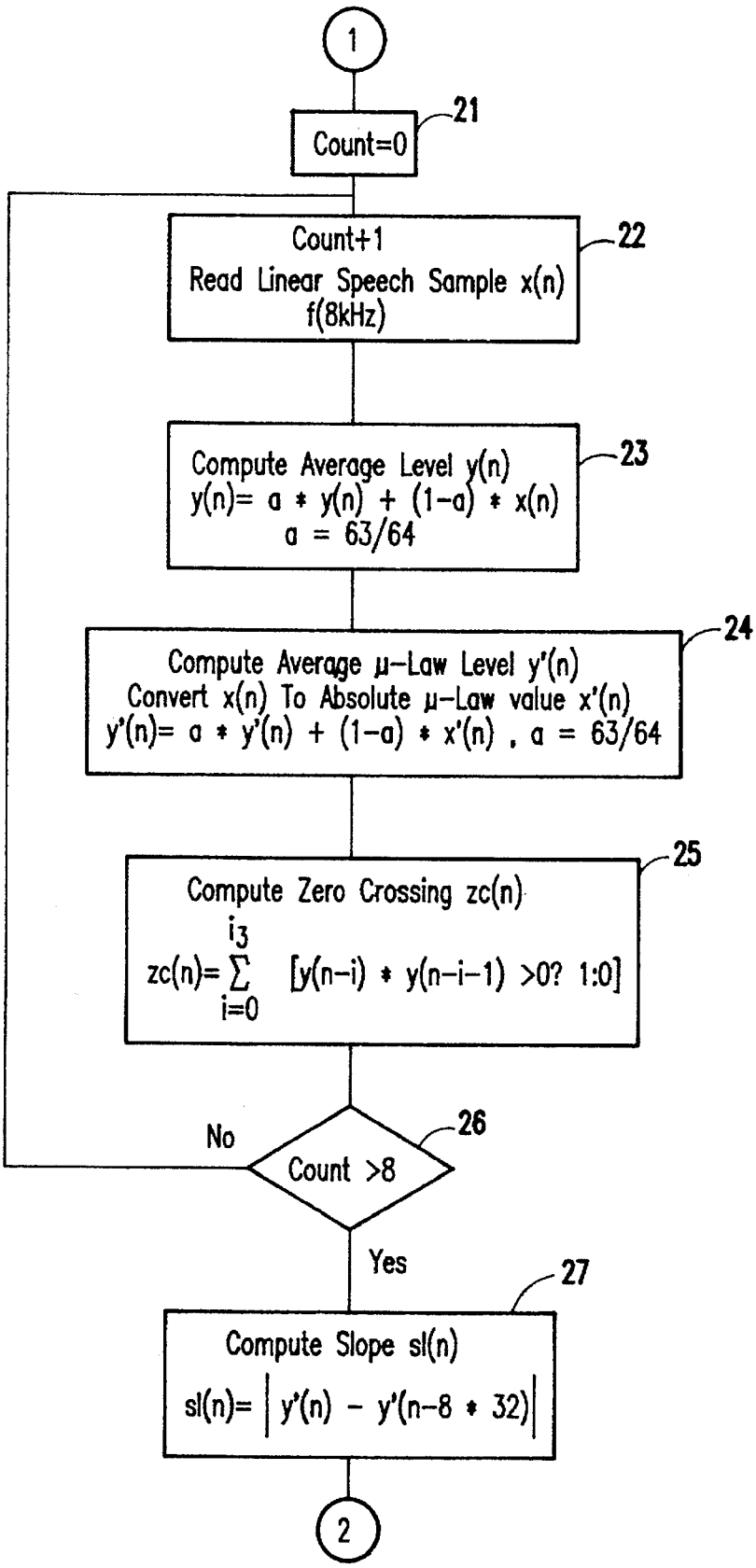
FIG. 3 is a flow diagram showing the logic of the process of the update signal parameters block of FIG. 2.

The logic of the updating process are shown in FIG. 3 to which reference is now made. Initially, the sample count is set to zero in function block 21. Then, the sample count is incremented for each sample in function block 22. Linear speech samples x(n) are read as 16-bit numbers at a frequency, f, of 8 kHz. The average level, y(n), is computed in function block 23. The level is computed as the short term average of the linear signal by low pass filtering the signal with a filter whose transform function is denoted in the z-domain as:

$$H(z)=\frac{1-a}{1-az^{-1}}\ . \tag{1}$$

The difference equation is $$y(n)=a\cdot y(n)+(1-a)\cdot x(n).$$

The time constant for the filter is approximated by $$\frac{T}{(1-a)}\ ,$$

where T is the sampling time for the variable (125 μs). For the level averaging, $$\alpha=\frac{63}{64}\ ,$$

giving a time constant of 8 ms. Then, in function block 24, the average μ-law level y'(n) is computed. This is done by converting the speech samples x(n) to an absolute/ μ-law value x'(n) and computing $$y'(n)=a\cdot y'(n)+(1-a)\cdot x'(n),\ a=\frac{63}{64}\ .$$

Next, in function block 25, the zero crossing, zc(n), is computed as $$zc(n)=\sum_{i=0}^{i_3}[y(n-i)\cdot y(n-i-1)>0?\ 1{:}0].$$

The zero crossing is computed over a sliding window of sixty-four samples of 8 ms duration. A test is then made in decision block 26 to determine if the count is greater than eight. If not, the process loops back to function block 22, but if the count is greater than eight, the slope, sl, is computed in function block 27 as $$sl(n)=|y'(n)-y'(n-8\cdot 32)|.$$

The slope is computed as the change in the average signal level from the value 32 ms back. For the slope calculations, the companded μ-law absolute values are used to compute the short term average giving rise to approximately a log Δ relationship. This differentiates the onset and decay signals better than using linear signal values.

Figure 4:
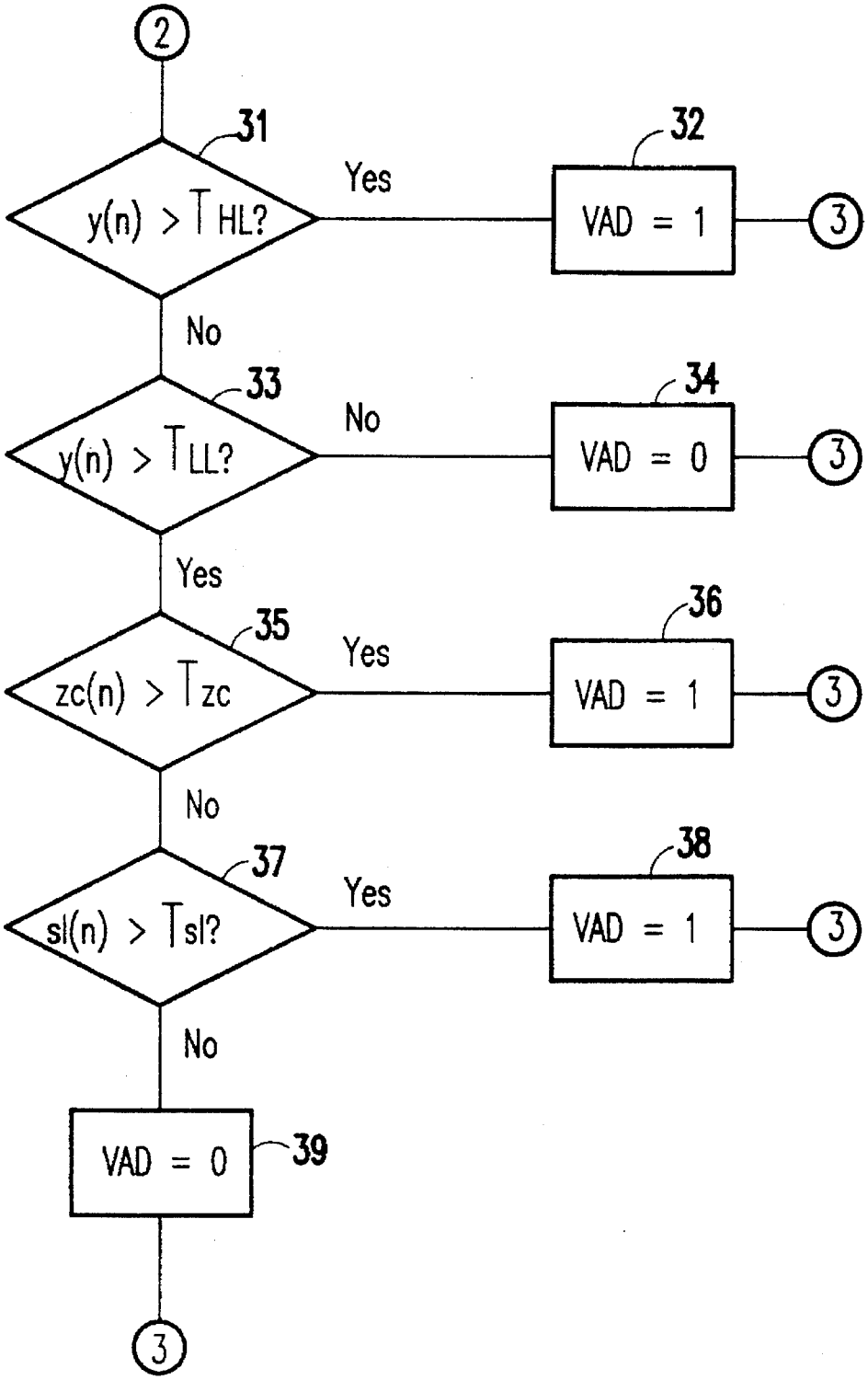
FIG. 4 is a flow diagram showing the logic of the process of the compare with thresholds block of FIG. 2.

The outputs of function block 27 are output to the compare with thresholds block 2 shown in FIG. 2. The flow diagram of the logic of this block is shown in FIG. 4, to which reference is now made. The above parameters are compared to a set of thresholds to set the VAD activity flag. Two thresholds are used for the level; a low level threshold ($T_{LL}$) and a high level threshold ($T_{HL}$). Initially, $T_{LL}$=−50 dBm0 and $T_{HL}$=−30 dBm0. The slope threshold ($T_{SL}$) is set at ten, and the zero crossing threshold ($T_{ZC}$) at twenty-four. If the level is above $T_{HL}$, then activity is declared (VAD=1). If not, activity is declared if the level is 3 dB above the low level threshold $T_{LL}$ and either the slope is above the slope threshold $T_{SL}$ or the zero crossing is above the zero crossing threshold $T_{ZC}$. More particularly, as shown in FIG. 4, y(n) is first compared with the high level threshold ($T_{HL}$) in decision block 31, and if greater than $T_{HL}$, the VAD flag is set to one in function block 32. If y(n) is not greater than $T_{HL}$, a further y(n) is then compared with the low level threshold ($T_{LL}$) in decision block 33. If y(n) is not greater than $T_{LL}$, the VAD flag is set to zero in function block 34. Next, if y(n) is greater than $T_{LL}$, the zero crossing, zc(n) is compared to the zero crossing threshold ($T_{ZC}$) in decision block 35. If zc(n) is greater than $T_{ZC}$, the VAD flag is set to one in function block 36. If zc(n) is not greater than $T_{ZC}$, a further test is made in decision block 37 to determine if the slope, sl(n), is greater than the slope threshold ($T_{sl}$). If it is, the VAD flag is set to one in function block 38, but if it is not, the VAD flag is set to zero in function block 39.

Figure 5:
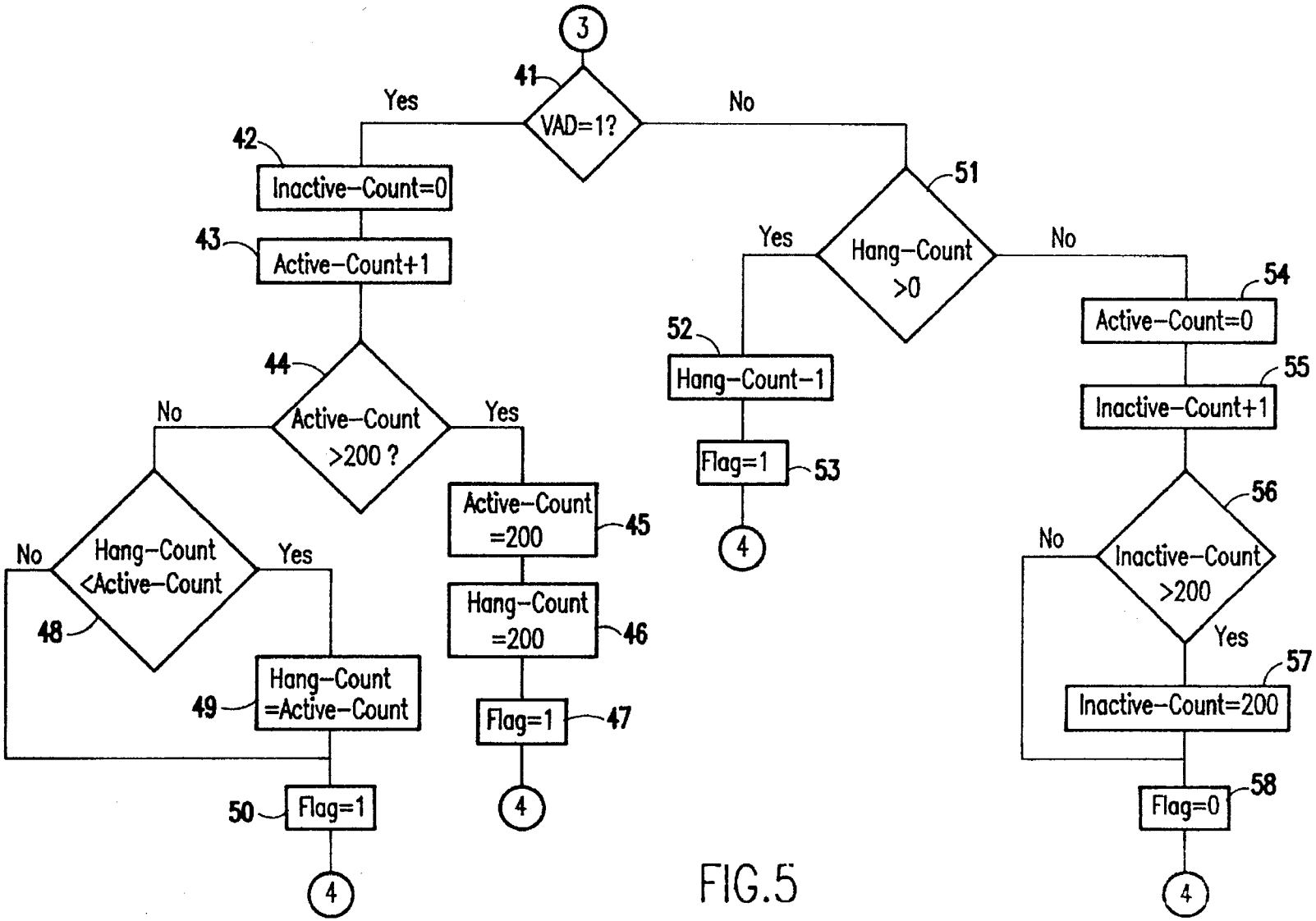
FIG. 5 is a flow diagram showing the logic of the process of the determine activity block of FIG. 2.

The VAD flag is used to determine activity in block 3 shown in FIG. 2. The logic of the this process is shown in FIG. 5, to which reference is now made. The process is divided in two parts, depending on the setting of the VAD flag. Decision block 41 detects whether the VAD flag has been set to a one or a zero. If a one, the process is initialized by setting the inactive count to zero in function block 42, then the active count is incremented by one in function block 43. A test is then made in decision block 44 to determine if the active count is greater than 200 ms. If it is, the active count is set to 200 ms in function block 45 and the hang count is also set to 200 ms in function block 46. Finally, a flag is set to one in function block 47 before the process exits to the next processing block. If, on the other hand, the active count is not greater than 200 ms as determined in decision block 44, a further test is made in decision block 48 to determine if the hang count is less than the active count. If so, the hang count is set equal to the active count in function block 49 and the flag set to one in function block 50 before the process exits to the next processing block; otherwise, the flag is set to one without changing the hang count.

If, on the other hand, the VAD flag is set to zero, as determined by decision block 41, then a test is made in decision block 51 to determine if the hang count is greater than zero. If so, the hang count is decremented in function block 52 and the flag is set to one in function block 53 before the process exits to the next processing block. If the hang count is not greater than zero, the active count is set to zero in function block 54, and the inactive count is incremented in function block 55. A test is then made in decision block 56 to determine if the inactive count is greater than 200 ms. If so, the inactive count is set to 200 ms in function block 57 and the flag is set to zero in function block 58 before the process exits to the next process. If the inactive count is not greater than 200 ms, the flag is set to zero without changing the inactive count.

Figure 6:
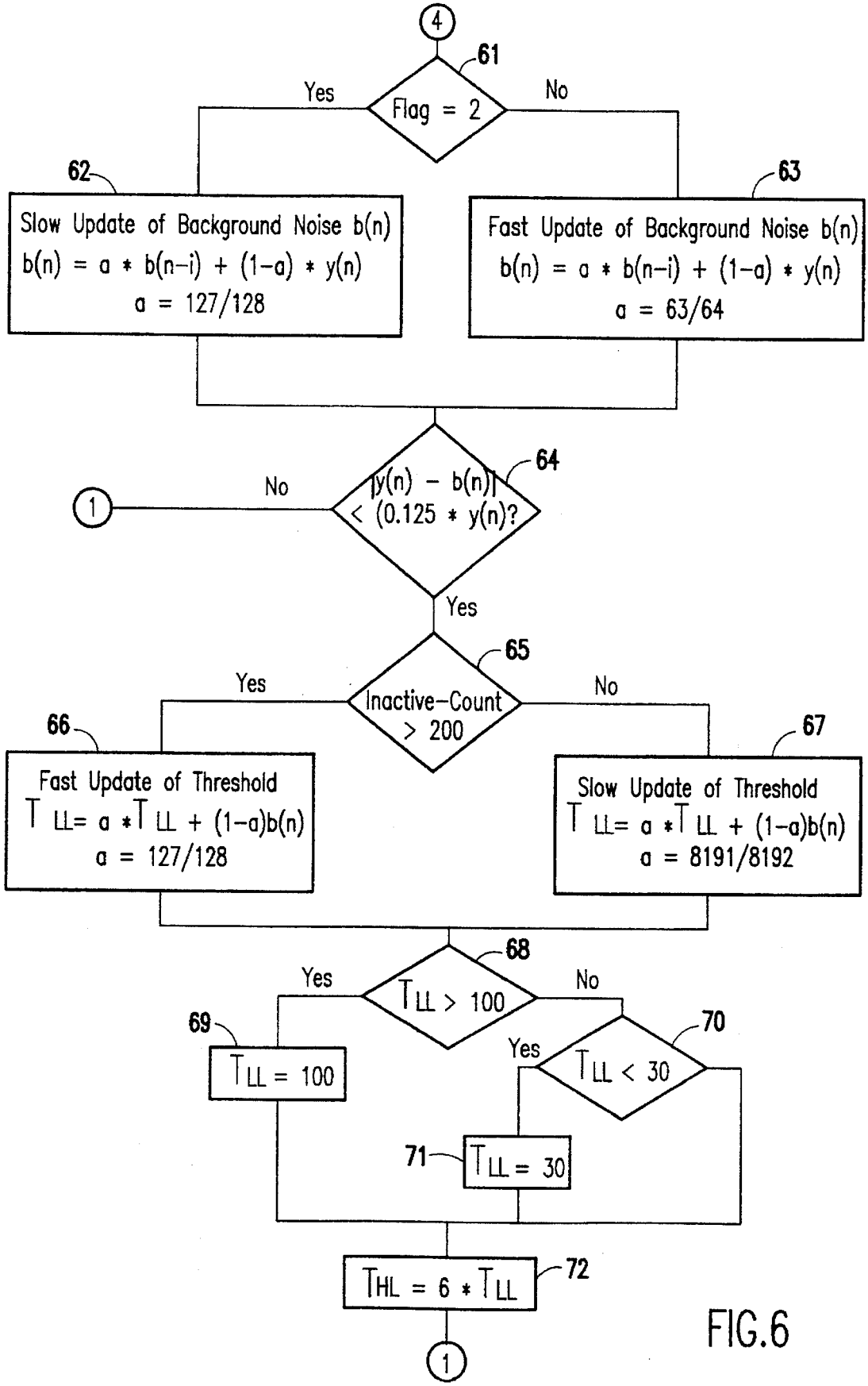
FIG. 6 is a flow diagram showing the logic of the process of update thresholds block of FIG. 2.

Based on whether the flag set in the process shown in FIG. 5, the thresholds are updated in block 4 shown in FIG. 2. The logic of this process is shown in FIG. 6, to which reference is now made. The level thresholds are adjusted with the background noise. By adjusting the level thresholds, the invention is able to adapt to the background noise and detect speech with minimal clipping and false alarms. An average background noise level is computed by sampling the average level at 1 kHz and using the filter in equation (1). If the flag is set in the activity detection process shown in FIG. 5, as determined in decision block 61, a slow update of the background noise, b(n), is used with a time constant of 128 ms in function block 62 as $$b(n) = a \cdot b(n-i) + (1-a) \cdot y(n),\ a = \frac{127}{128}\ .$$

If no activity is declared, a faster update with a time constant of 64 ms is used in function block 63. The level thresholds are updated only if the average level is within 12.5% of the average background noise to avoid the updates during speech. Thus, in decision block 64, the absolute value of the difference between y(n) and b(n) is compared with 0.125•y (n), and if less than that value, the process loops back to the process of updating signal parameters shown in FIG. 2 without updating the thresholds. Assuming, however, that the thresholds are to be updated, the low level threshold is updated by filtering the average background noise with the above filter with a time constant of 8 ms. A test is made in decision block 65 to determine if the inactive count is greater than 200 ms. If the inactive count exceeds 200 ms, then a faster update of 128 ms is used in function block 66 as $$T_{LL} = a \cdot T_{LL} + (1-a)b(n),\ a = \frac{127}{128}\ .$$

This is to ensure that the low level threshold rapidly tracks the background noise. If the inactive count is less than 200 ms, then a slower update of 8192 ms is used in function block 67. The low level threshold has a maximum ceiling of −30 dBm0. $T_{LL}$, is tested in decision block 68 to determine if it is greater than 100. If so, $T_{LL}$ is set to 100 in function block 69; otherwise, a further test is made in decision block 70 to determine if $T_{LL}$ is less than 30. If so, $T_{LL}$, is set to 30 in function block 71. The high level threshold, $T_{HL}$, is then set at 20 dB higher than the low level threshold, $T_{LL}$, in function block 72. The process then loops back to update thresholds as shown in FIG. 2.

A variable length hangover is used to prevent back-end clipping and rapid transitions of the VAD state within a talk spurt. The hangover time is made proportional to the duration of the current activity to a maximum of 200 ms.

While the invention has been described in terms of a single preferred embodiment, those skilled in the art will recognize that the invention can be practiced with modification within the spirit and scope of the appended claims.

Having thus described our invention, what we claim as new and desire to secure by Letters Patent is as follows:

1. A method of detecting voice activity in received voice signal samples including background noise, comprising the steps of:

deriving voice signal parameters from the voice signal samples, wherein the voice signal parameters include an average signal level, calculated as a short-term average energy of the voice signal samples, and a slope, calculated as an absolute value of a change in the average signal level;

comparing the voice signal parameters with voice signal parameter thresholds and setting a Voice Activity Detection (VAD) flag according to the results of the comparisons;

updating the voice signal parameter thresholds at a first frequency to ensure rapid tracking of the background noise if the VAD flag is not set; and updating the voice signal parameter thresholds at a second slower frequency for slower tracking of the background noise if the VAD flag is set.

2. The method of detecting voice activity as recited in claim 1, wherein the voice signal parameters further include a zero crossing count.

3. The method of detecting voice activity as recited in claim 2, wherein the zero crossing count is calculated over a sliding window.

4. The method of detecting voice activity as recited in claim 2, wherein the step of comparing the voice signal parameters with voice signal parameter thresholds further comprises the steps of:

comparing the average signal level with a high level threshold and setting the VAD flag if the average signal level is above the high level threshold; but if the average signal level is not above the high level threshold, then comparing the average signal level with a low level threshold and setting the VAD flag if the average signal level is above the low level threshold and either the slope is above a slope threshold or the zero crossing count is above a zero crossing count threshold.

5. The method of detecting voice activity as recited in claim 1, wherein:

the step of updating the voice signal parameter thresholds at the first frequency comprises updating in accordance with a first update time constant for controlling the first frequency; and the step of updating the voice signal parameter thresholds at the second frequency comprises updating in accordance with a second update time constant for controlling the second frequency.

6. A voice activity detector for detecting voice activity in received voice signal samples including background noise, comprising:

a calculator for calculating voice signal parameters from the voice signal samples, the voice signal parameters including:

an average signal level, calculated as a short-term average energy of the voice signal samples; and a slope, calculated as an absolute value of a change in the average signal level;

a comparator for comparing the voice signal parameters with voice signal parameter thresholds, wherein a Voice Activity Detection (VAD) flag is set based on the comparisons; and an updater for updating the voice signal parameter thresholds at a first frequency to ensure rapid tracking of the background noise if the VAD flag is not set, and updating the voice signal parameter thresholds at a second slower frequency for slower tracking of the background noise if the VAD flag is set.

7. The voice activity detector of claim 6, wherein the voice signal parameters calculated by the calculator further include a zero crossing count.

8. The voice activity detector of claim 7, wherein the zero crossing count is calculated over a sliding window.

9. The voice activity detector of claim 7, wherein the comparator compares the average signal level with a high level threshold and sets the VAD flag if the average signal level is above the high level threshold; but if the average signal level is not above the high level threshold, the comparator compares the average signal level with a low level threshold and sets the VAD flag if the average signal level is above the low level threshold and either the slope is above a slope threshold or the zero crossing count is above a zero crossing count threshold.

10. The voice activity detector of claim 6, wherein the updater updates the voice signal parameter thresholds at the first frequency in accordance with a first update time constant for controlling the first frequency, and updates the voice signal parameter thresholds at the second frequency in accordance with a second update time constant for controlling the second frequency.

11. A memory device storing instructions to be implemented by a data processor in a communications system, for detecting voice activity in received voice signal samples including background noise, the instructions comprising:

instructions for deriving voice signal parameters from the voice signal samples, wherein the voice signal parameters include an average signal level, calculated as a short-term average energy of the voice signal samples, and a slope, calculated as an absolute value of a change in the average signal level;

instructions for comparing the voice signal parameters with voice signal parameter thresholds and setting a Voice Activity Detection (VAD) flag according to the results of the comparisons;

instructions for updating the voice signal parameter thresholds at a first frequency to ensure rapid tracking of the background noise if the VAD flag is not set; and instructions for updating the voice signal parameter thresholds at a second slower frequency for slower tracking of the background noise if the VAD flag is set.

12. The memory device of claim 11, wherein the voice signal parameters further include a zero crossing count.

13. The memory device of claim 12, wherein the zero crossing count is calculated over a sliding window.

14. The memory device of claim 12, wherein the instructions for comparing the voice signal parameters with voice signal parameter thresholds further comprises:

instructions for comparing the average signal level with a high level threshold and setting the VAD flag if the average signal level is above the high level threshold, but if the average signal level is not above the high level threshold, then comparing the average signal level with a low level threshold and setting the VAD flag if the average signal level is above the low level threshold and either the slope is above a slope threshold or the zero crossing count is above a zero crossing count threshold.

15. The memory device of claim 11, wherein the stored instructions further comprise:

instructions for updating the voice signal parameter thresholds at the first frequency in accordance with a first update time constant for controlling the first frequency; and instructions for updating the voice signal parameter thresholds at the second frequency in accordance with a second update time constant for controlling the second frequency.

16. A voice activity detector for detecting voice activity in received voice signal samples comprising:

means for deriving voice signal parameters from the voice signal samples, including means for calculating an average signal level as a short-term average energy of the voice signal samples, and means for calculating a slope as an absolute value of a change in the average signal level;

means for comparing the voice signal parameters with voice signal parameter thresholds;

means for setting a Voice Activity Detection (VAD) flag according to the results of the comparisons;

means for updating the voice signal parameter thresholds at a first frequency to ensure rapid tracking of the background noise if the VAD flag is not set; and means for updating the voice signal parameter thresholds at a second slower frequency for slower tracking of the background noise if the VAD flag is set.

17. The voice activity detector recited in claim 16, wherein the means for deriving voice signal parameters further includes means for calculating a zero crossing count.

18. The voice activity detector recited in claim 17, wherein the means for calculating the zero crossing count calculates the zero crossing count over a sliding window.

19. The voice activity detector recited in claim 17, wherein the means for comparing the voice signal parameters with voice signal parameter thresholds compares the average signal level with a high level threshold and sets the VAD flag if the average signal level is above the high level threshold; but if the average signal level is not above the high level threshold, the means for comparing compares the average signal level with a low level threshold and sets the VAD flag if the average signal level is above the low level threshold and either the slope is above a slope threshold or the zero crossing count is above a zero crossing count threshold.

20. The voice activity detector recited in claim 16, wherein:

the means for updating the voice signal parameter thresholds at the first frequency updates in accordance with a first update time constant for controlling the first frequency; and the means for updating the voice signal parameter thresholds at the second frequency updates in accordance with a second update time constant for controlling the second frequency.

* * * * *